United States Patent [19]

Gilardi

[11] 4,435,014

[45] Mar. 6, 1984

[54] ELASTIC INSERT FOR SEATS, IN PARTICULAR FOR MOTOR VEHICLE SEATS

[75] Inventor: Enrico Gilardi, Robbio, Italy

[73] Assignee: Gestioni Riunite Toscana Gomma S.p.A., Robbio, Italy

[21] Appl. No.: 274,081

[22] Filed: Jun. 16, 1981

[30] Foreign Application Priority Data

Jul. 18, 1980 [IT] Italy ..... 23561 A/80

[51] Int. Cl.[3] ..... A47C 7/02

[52] U.S. Cl. ..... 297/452; 5/186 R

[58] Field of Search ..... 297/452; 5/191, 199, 5/481, 233, 186 R, 186 B; 160/400

[56] References Cited

U.S. PATENT DOCUMENTS

| | | | |
|---|---|---|---|
| 1,184,763 | 5/1916 | Mangan | 5/192 |
| 1,716,176 | 6/1929 | Keresztfalvy | 5/191 |
| 3,363,943 | 1/1968 | Getz et al. | 297/452 |
| 3,425,067 | 2/1969 | Frig et al. | 5/186 R |
| 3,529,866 | 9/1970 | Getz | 297/452 |
| 3,557,264 | 1/1971 | Getz et al. | 297/452 |
| 3,913,978 | 10/1975 | Lester | 297/452 |

*Primary Examiner*—Francis K. Zugel

*Attorney, Agent, or Firm*—Ladas & Parry

[57] ABSTRACT

A flexible insert is provided for attachment to a seat support frame. The insert comprises a flexible plate having an aperture and having at an end of said plate a crossbar with an insertion slot. An elastic annular element is connected to said plate by insertion into an aperture in said plate delimited by said crossbar.

The flexible plate may be connected through said elastic annular element to another flexible plate. Connection of the flexible plate to the support frame may be made by securing means attached to the frame and connected either to the flexible plate or to the elastic annular element.

12 Claims, 7 Drawing Figures

ELASTIC INSERT FOR SEATS, IN PARTICULAR FOR MOTOR VEHICLE SEATS

DESCRIPTION

This invention relates to an insert for seats in general and, in particular, to seat cushions and backs of seats for motor vehicle seats.

With reference to motor vehicle seats, to which the invention is specifically but not exclusively applied, said seats are provided with a tubular metal frame apt to support the padding by means of the elastic inset or inserts. The known types of inserts consist of a flexible structure comprising steel springs and denote considerable drawbacks caused by friction between the elements of said structure and the fixing ends. Moreover, deformation of the springs can cause breakage and destruction of the padding as well as noise and creaking due to the metal parts rubbing against each other. Furthermore, the embodiment of such inserts is complex and consequently uneconomic.

The present invention proposes to eliminate the above and other drawbacks and to provide an elastic insert, satisfactory from all aspects and which allows to obtain in an easy and rational manner, predetermined and controlled springing actions according to the requirements and end use of the invention. A further object of the invention is to provide an insert which besides having the desired comfort is of simple construction, which obviously leads to economic advantages.

The insert according to the present invention is characterized in that together with the metal supporting frame, it has at least one flexible plate connected to said frame by elastic elements. The elastic elements are advantageously made in rubber or a similar material and have a practically continuous and flat surface, said elements being secured to said supporting frame. This concept can, in practice, lead to various embodiments of the insert all of which fall within the scope of the present invention.

The continuous surface elastic elements are, at least in part, annularly shaped, securable, on one side, to the flexible plate or plates and, on the other side, to the supporting frame of the insert.

In order to provide inserts having areas of different and desired elasticity, the flexible plate or plates are provided with shaped apertures apt to delimit the zones of controlled flexibility, in order to form zones of differing longitudinal or transversal flexibility. According to one advantageous embodiment of the insert, the flexible plates are made of plastic material, such a polyethylene, polypropylene, etc., preferably obtained by molding, and the thickness of which may be conveniently varied. Moreover, the plates may incorporate reinforcements, such as cross bars or similar expedients, to retain connecting means and securing hooks.

The invention will now be described in conjunction with the annexed drawings which illustrate, by way of example, some forms of embodiment of the insert according to the present invention.

In the drawings:

FIG. 4 is a variant of the embodiment of the back of the seat according to FIG. 2, whereas

Figure 2:
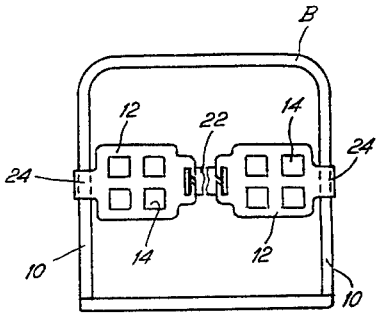
FIG. 2 is a detail, in elevation of the frame of the back of the seat shown in FIG. 1.
Figure 7:
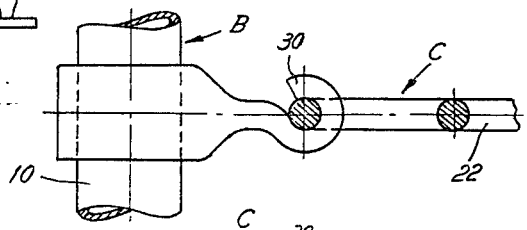
Figure 6:
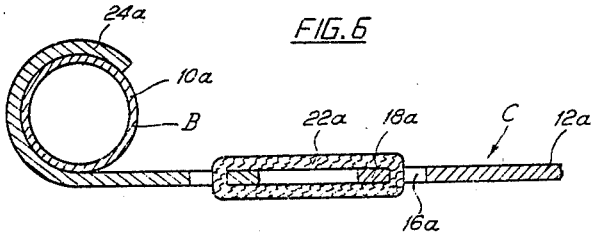

FIG. 6, identical to FIG. 2, shows in transversal cross-section a further embodiment of the insert;

FIG. 7, is a variation of the embodiment of an elastic element.

With reference to the figures in the drawings, A indicates the seat, the seat cushion of which is equipped, in the known manner, with a reclining seat back. The seat back and seat cushion are both fitted with a metal frame B (see also FIGS. 2 and 3) of suitable contour and advantageously consisting of a tubular metal element 10 apt to retain, as described herebelow, insert C consisting of one or more plates 12, suitably arranged with respect to each other in rows or columns.

Figure 3:
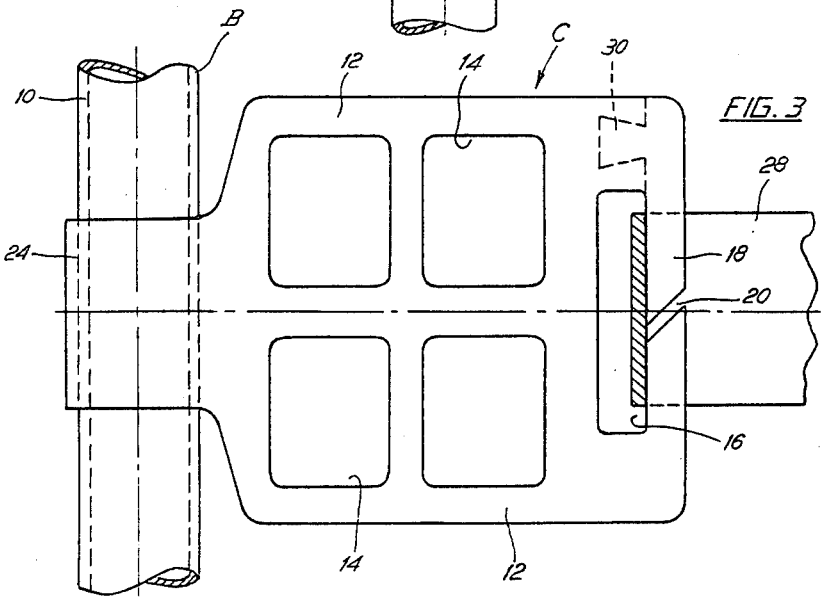
FIG. 3 is a detail on a scale larger than that of FIG. 2.

The insert shown in FIGS. 2 and 3 of the drawing consists of a plurality of flexible plates arranged in rows with respect to supporting frame B. In the case illustrated, plates 12 are two in number per row, each being conveniently arranged for the purposes to be explained hereafter.

Each one of flexible plates 12 is provided, at one of its vertical ends, with an aperture 16 which forms a cross bar 18, provided in its mid part with a slot 20 conveniently inclined with respect to the longitudinal axis of said cross bar.

Cross bar 18 is adapted to retain an elastic element 22 which, in the case illustrated, is annularly shaped and joins the two or more flexible plates 12 which constitute the row or rows retained by supporting frame B to each other, thereby exerting on said plates a traction.

The other vertical end of flexible plate 12 considered in FIGS. 2 and 3, terminates with a fin 24 which is folded as a hook to embrace, with an amplitude of at least 180°, risers 10 of supporting frame B to ensure the securing of insert C to said frame.

Figure 1:
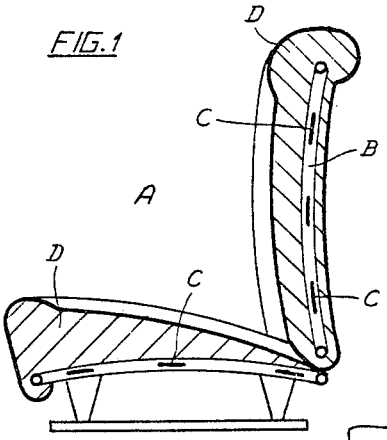
FIG. 1 is the vertical cross-section of a motor vehicle seat, with seat cushion and back of seat, provided with the inserts according to the present invention.
Figure 4:
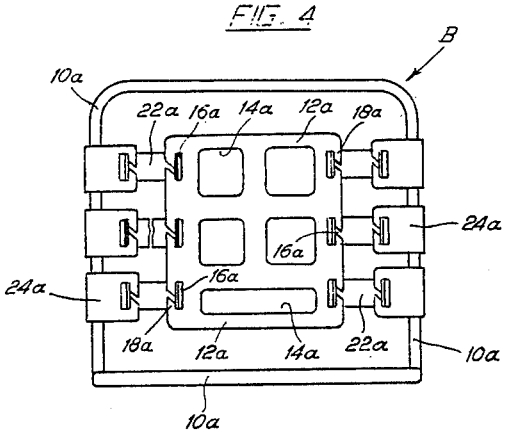

FIG. 4 shows a different embodiment of insert C for one of the frames B of the seal illustrated in FIG. 1. Insert C of the embodiment consists of one only flexible plate **12*a*, of a suitable width, provided along its vertical edges with a plurality of slots 16*a* which retain corresponding elastic annular elements 22*a*. Each one of said elements is secured to riser 10*a* of frame B by means of a plate, the extremity 24** of which is folded over to form a hook (see also FIG. 6).

Figure 5:
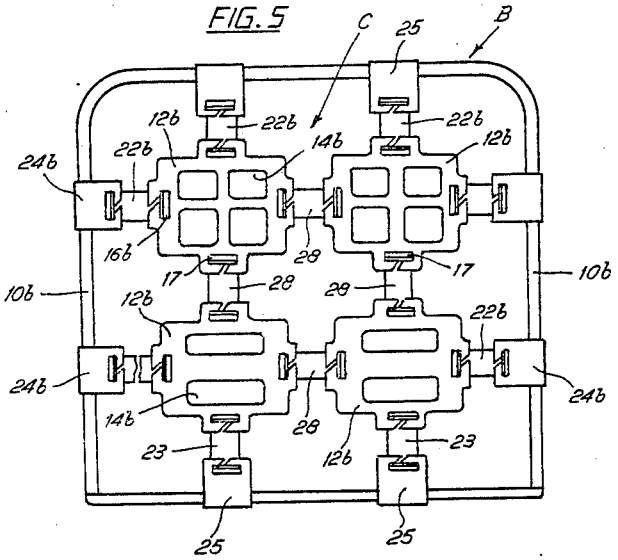
FIG. 5 is a detail in cross-section.

In the version according to FIG. 5, insert C, held by frame B, consists of a plurality of flexible plates **12*b* arranged according to rows and columns perpendicular to each other. Each of said plates is provided with slots 16*b* and 17 on its longitudinal and transversal edges, apt to retain annular elastic elements 22*b* and 23, secured to said frame B by means of hooks 24*b* and 25**.

Moreover, two or more of flexible plates **12*b* are vertically and/or horizontally connected to one another by intermediate elastic elements 28, secured to plates by slots 17** on the edges of said contiguous plates.

Lastly, FIG. 7 illustrates a variation of the embodiment of the elastic element consisting of a tension element 22 having a slotted end, the extremities of which are secured, respectively, one to the flexible plate and the other to frame B by means of hooks 40 in said frame.

Other variations and modifications may be embodied according to different requisites of use called for in each case, for example, and as shown in FIG. 3, the engagement of elastic elements 22 in apertures 16 of flexible plates 12 may be implemented by a feather edge or a dove tail connection 30, provided in a suitable position between cross piece 18 and the corresponding extremity of flexible plate 12. Moreover, and in order to provide an insert C having the desired characteristics of elasticity and flexibility, apertures 14 in flexible plates 12 can be conveniently shaped so as to obtain longitudinal and/or transversal areas of different flexibility. The possibility is not excluded of manufacturing said plates 12, at least in part, with a metallic material and that is, at the limits, said plates may be made totally in metal or provided with metallic reinforcements embedded or distributed in their different sections, particularly in the position of cross bars 18 and/or securing hooks 24.

The same applies to elastic elements 22, the width and/or thickness of which may vary depending on the elastic action they are to develop.

It is understood that the present invention also covers the seat, the seat cushion and/or seat back which incorporate the insert according to the invention.

In practice, the construction details may be varied without, however, departing from the scope of the invention and, therefore, from the field of the patent.

I claim:

1. A flexible insert for cushions of seats, the seats having a support frame, the insert comprising:

a flexible plate (12) having an aperture (14) therein; a cross-bar (18) located at one end of said flexible plate and having an insertion slot (20,30) therein; and an elastic annular element (22) connected to said cross-bar of said flexible plate.

2. An insert as in claim 1, wherein the insertion slot traverses the cross-bar at an acute angle.

3. An insert as in claim 1 wherein the cross-bar has in correspondence with one of its extremities a feather edge coupling (30) adapted to permit insertion into aperture (16) of one or more elastic annular elements (22).

4. An insert as in claim 1, wherein the elastic annular element connects the flexible plate to a second adjacent flexible plate.

5. An insert as in claim 4, comprising a plurality of similar flexible plates arranged in rows and columns, and connected by elastic annular elements.

6. An insert as in claim 1, wherein the elastic elements (22) are made of rubber or a similar material and have a practically continuous and flat surface.

7. An insert as in claim 6 or 1, wherein the flexible plate (12) has, on at least part of its edges, an aperture (16) delimiting the cross-bar (18) and to which the annular elastic element (22) is secured.

8. An insert as in any one of claims 6, 1, 2, 4 or 5 wherein flexible plate (12) is provided, on one of its edges, opposite cross bar (18) with securing means (24), attachable to the support frame of the cushion.

9. An insert as in claim 8, wherein the support frame has connecting elements (10) therein and the securing means in the flexible plate comprises hooks (24) engageable with the connecting elements (10).

10. An insert as in claim 5, wherein each flexible element is made of suitable plastic material and is provided with a suitable shaped aperture (14), forming zones of different flexibility.

11. An insert as in any one of claims 1 or 4, characterized in that at least a part of one flexible plate (12) is reinforced.

12. An insert as in any one of claims 6, 1, 3, 4 or 5, wherein the hooks (24) are connected to said plates by annular elastic elements.

* * * * *